US006102484A

United States Patent [19]

Young, III

[11] Patent Number: 6,102,484

[45] Date of Patent: Aug. 15, 2000

[54] CONTROLLED FOAM INJECTION METHOD AND MEANS FOR FRAGMENTATION OF HARD COMPACT ROCK AND CONCRETE

[75] Inventor: Chapman Young, III, Steamboat Springs, Colo.

[73] Assignee: Applied Geodynamics, Inc., Steamboat Springs, Colo.

[21] Appl. No.: 08/903,043

[22] Filed: Jul. 29, 1997

Related U.S. Application Data

[60] Provisional application No. 60/022,416, Jul. 30, 1996.

[51] Int. Cl.[7] ..... E21C 37/12; E21C 37/04

[52] U.S. Cl. ..... 299/16; 299/21; 166/177.5; 166/308

[58] Field of Search ..... 299/13, 16, 21; 166/177.5, 308

[56] References Cited

U.S. PATENT DOCUMENTS

| | | | |
|---|---|---|---|
| 3,307,445 | 3/1967 | Stadler et al. . | |
| 3,988,037 | 10/1976 | Denisart et al. | 299/16 |
| 4,099,784 | 7/1978 | Cooper | 299/10 |
| 4,121,664 | 10/1978 | Fischer et al. | 166/309 |
| 4,121,674 | 10/1978 | Fischer et al. | 175/66 |
| 4,123,108 | 10/1978 | Lavon | 299/16 |
| 4,141,592 | 2/1979 | Lavon | 299/16 |
| 4,195,885 | 4/1980 | Lavon | 299/17 X |
| 4,204,715 | 5/1980 | Lavon | 299/16 |
| 4,266,827 | 5/1981 | Cheney | 299/20 |
| 4,394,051 | 7/1983 | Oudenhoven | 299/16 |
| 4,449,754 | 5/1984 | Orlov et al. | 299/21 |
| 4,457,375 | 7/1984 | Cummins | 166/309 |
| 4,615,564 | 10/1986 | Garrett | 299/7 |
| 4,780,243 | 10/1988 | Edgley et al. | 516/11 |

(List continued on next page.)

FOREIGN PATENT DOCUMENTS

| | | | |
|---|---|---|---|
| 3617024 | 11/1987 | Germany | 299/16 |
| 55-2140 | 9/1980 | Japan | 299/16 |
| 4312693 | 11/1992 | Japan | 175/69 |
| 5 149078 | 6/1993 | Japan | 175/69 |
| 0834346 | 5/1981 | U.S.S.R. | 299/16 |
| 1343020 | 10/1987 | U.S.S.R. | 299/16 |
| 1502830 | 8/1989 | U.S.S.R. | 299/16 |
| 1686159 | 10/1991 | U.S.S.R. | 299/16 |
| 800883 | 9/1958 | United Kingdom . | |
| 942750 | 11/1963 | United Kingdom . | |
| 1454454 | 11/1976 | United Kingdom | 299/16 |

OTHER PUBLICATIONS

Nantel et al. "Plasma Blasting Techniques"Fragblast '90, Brisbane Aug. 26–31.

Anderson et al. "Laboratory testing of a Radial–Axial Loading . . . "Bureau of Mines REport of Investigations, 1982, RI8722.

R. L. Sparks, "A Technique for Obtaining In–Situ Saturations . . . "SPE 10065.

*Primary Examiner*—Eileen Dunn Lillis
*Assistant Examiner*—Sunil Singh
*Attorney, Agent, or Firm*—James Creighton Wray; Meera P. Narasimhan

[57] ABSTRACT

Breaking hard compact materials, such as rock and concrete, is based upon a controlled-fracturing process wherein a high-pressure foam is used to pressurize a pre-drilled hole of appropriate geometry. The high-pressure foam is delivered to the bottom of the drilled hole by a barrel inserted into the hole. The barrel includes an end seal for sealing near the bottom of the hole. By restricting and controlling the pressure of the high-pressure foam to the bottom of the hole, a controlled fracturing is achieved which results in the fracturing and removing of a large volume of material at a low expenditure of energy. The foam-injection method produces almost no fly rock nor airblast. The foam-injection method may be used to fracture, remove and/or excavate any hard material such as rock or concrete. The method may be used in either dry or water filled holes and the holes may be in any orientation. The foam injection apparatus is carried on a boom mounted on a carrier. An indexing mechanism allows both a drill and a foam injection apparatus to be used on the same boom for drilling and subsequent high-pressure foam injection.

38 Claims, 4 Drawing Sheets

U.S. PATENT DOCUMENTS

| | | | |
|---|---|---|---|
| 4,863,220 | 9/1989 | Kolle | 299/16 |
| 4,900,092 | 2/1990 | Von Der Westhuizen et al. | 299/13 |
| 5,098,163 | 3/1992 | Young, III | 299/13 |
| 5,199,766 | 4/1993 | Montgomery | 299/5 |
| 5,249,635 | 10/1993 | King et al. | 175/48 |
| 5,308,149 | 5/1994 | Watson et al. | 299/13 |
| 5,372,195 | 12/1994 | Swanson et al. | 166/308 |
| 5,385,206 | 1/1995 | Thomas | 166/267 |
| 5,398,998 | 3/1995 | Evans | 299/21 |
| 5,474,129 | 12/1995 | Weng et al. | 166/308 |
| 5,513,712 | 5/1996 | Sydansk | 175/69 |

CONTROLLED FOAM INJECTION METHOD AND MEANS FOR FRAGMENTATION OF HARD COMPACT ROCK AND CONCRETE

This application claims the benefit of Provisional U.S. application, Ser. No. 60/022,416 filed Jul. 30, 1996.

BACKGROUND OF THE INVENTION

The invention is a continuous excavation/demolition system based upon the controlled fracturing of hard competent rock and concrete through the controlled application of a high-pressure foam-based fluid in pre-drilled holes.

For over a century explosive blasting has been the primary means used for the excavation of hard rock and often the demolition of concrete structures. In recent years several small-scale methods employing small explosive or propellant charges or specialized mechanical and hydraulic loading means have been proposed as alternatives to conventional blasting. Conventional blasting is limited in that it requires special precautions due to the use of explosives and that it can cause excessive damage to the rock or concrete being broken. The smaller scale specialized techniques, while finding many niche applications, have been limited in their ability to break harder rocks or in having undesirable operating characteristics. For example, the small-charge explosive and propellant techniques still generate significant airblast and fly rock.

Efforts to develop alternatives to conventional explosive excavation and demolition have included water jets, firing high velocity slugs of water into predrilled holes, rapidly pressurizing predrilled holes with water or propellant generated gases, mechanically loading predrilled holes with specialized splitters, various mechanical impact devices and a broad range of improvements on mechanical cutters. Each of these methods may be evaluated in terms of specific energy (the energy required to excavate or demolish a unit volume of material), their working environment, their complexity, their compatibility with other excavation operations, and the like.

The specific energy required to excavate rock or demolish rock or concrete with any existing technique is found to be extremely high as compared to the energy required to form the fractures needed to achieve the desired breakage. For example, rocks have a laboratory determined fracture energy ranging from 10 to 500 Joules per square meter, this being the work (energy) required to create the two faces of a new fracture. Taking 100 $J/m^2$ as representative and requiring that the rock be broken into 1 mm (0.001 m) fragments dictates that 300,000 Joules per cubic meter of material be expended on fracturing alone. In contrast, conventional drill and blast requires an expenditure, including drilling of the shot holes, of 30,000,000 Joules per cubic meter (30 $MJ/m^3$) and conventional drilling and tunnel boring machine operations require on the order of 300 $MJ/m^3$.

The energy expended in all existing methods of excavation and demolition exceeds the energy needed to accomplish the desired result by 100 to 1000 orders of magnitude. This very large difference indicates that the existing methods are quite inefficient.

Controlled fracture methods, in various forms, have been proposed for several years as means to excavate or demolish rock and concrete more efficiently. Denisart (1976) proposed the rapid pressurization of a predrilled hole by firing a steel piston into a water filled hole such that a preferred (controlled) fracture would be initiated at the hole bottom and by propagating back to the surface from which the hole was drilled would efficiently remove a volume of the material.

Lavon (1978, 1979, 1980a and 1980b) proposed a variety of hydraulic cannons such that a high-velocity slug of liquid (water) could effect an efficient fracturing, excavation or demolition upon being fired into a predrilled hole.

Alternative methods for fracturing rock with hydraulic fluid pressure have been proposed by Cheney (1981) and Oudenhoven (1983). Cheney proposed placing a barrel type device with a mechanical (wedge and feather) collet to hold the device in the hole and a separate resilient sealing member (of elastomer, for example) into a pre-drilled hole and then pressurizing the bottom of the hole with a relatively incompressible fluid such as water so as to fracture the material to be broken. Oudenhoven proposed a very similar approach, but stipulated the cutting of a notch or groove near the bottom of the hole to assist in fracture initiation. Oudenhoven also proposed utilizing a single elastomer type of seal to hold the device in the hole and to provide for reasonable hole sealing. Neither Cheney nor Oudenhoven foresaw the possible use of foam as the fracturing fluid nor did they foresee the use of a seal of a deformable granular or cementitious material.

Cooper (1978) proposed a mechanical splitter such that both radial (perpendicular to the axis of a hole) forces and axial forces could be exerted upon a predrilled hole so that fracture would be initiated near the hole bottom and would propagate essentially parallel to the face from which the hole was drilled. Additional research and development on the radial-axial splitter has been carried out by the U.S. Bureau of Mines (Anderson and Swanson, 1982). The radial-axial splitter is limited in that the breaking forces are only applied to the sides and bottom of the drilled hole and are not applied to the fracture surfaces as the fractures develop. As fracturing must thus be accomplished without the benefit of fracture pressurization, the required stresses are much higher than needed for the fluid pressurization methods.

Realizing the benefits that might be achieved with the controlled fracturing of a material with a properly applied controlled pressure, Young (1990, 1992) proposed the use of small propellant charges to provide the requisite pressurization of a predrilled hole. Young noted that such pressurization would have to be restricted to the bottom of the hole by appropriate sealing means but that when such sealing was achieved a characteristic fracture would form at the sharp corner of the hole bottom. This characteristic fracture would initially propagate down into the material but would then turn back to the surface from which the hole was drilled as free surface effects began to control fracture propagation. The resulting breakage often left a cone on the rock face with the bottom of the predrilled hole defining the top of the cone. The method has since come to be known as the Penetrating Cone Fracture (PCF) method.

Propellants have been proposed earlier for the breaking of softer rocks such as coal (Davidson, 1956; Hercules, 1963 and Stadler et al, 1967) but these approaches did not envision the use of borehole sealing as used in the PCF method. Van Der Westhuisen (1990) also proposed a propellant based device for breaking boulders or other rocks with numerous free faces. As this device did not provide for any sealing near the hole bottom, it would not be expected to be efficient in excavating in-place rock.

Other propellant based rock fragmentation systems have been proposed by Watson and Young (1994), Ruzzi and Morrell (1995) and McCarthy (1997). Watson and Young provided for a high-strength cartridge which could be placed in a pre-drilled hole on the end of a stemming bar. The high-strength cartridge, by deforming to the borehole wall, would provide for the sealing and containment of the propellant gases near the hole bottom.

Ruzzi and Morrell provided for a mechanical (wedge and feathers) seal near the bottom of a pre-drilled hole such that the gases generated by the ignition of a propellant cartridge positioned on the end of the stemming/sealing bar would be contained near the hole bottom. McCarthy proposed a method for rapidly displacing a propellant cartridge to the bottom of a pre-drilled hole such that the propellant is ignited when the cartridge strikes the hole bottom. None of these three methods provide for the degree of hole bottom sealing required for effective breakage, especially if breakage is limited to one free face (the face into which the hole is drilled).

A high-pressure water injection device has been proposed by Kolle and Monserod (1991) and the rapid discharge of electrical energy from a high-voltage capacitor has been proposed by Nantel et al (1990). Again neither approach stipulated any sealing near the hole bottom. Breakage from the high-pressure water injection device is limited by the limited expandability of water as compared to a gas and the associated limits upon maintaining adequate fracture pressurization. Breakage from the electrical discharge device is limited by the rapid quenching of the electrical discharge generated gases once the gases (essentially steam) enter the rock fractures resulting in loss of adequate pressure for efficient fracturing.

The propellant techniques may have the advantage of providing a high-pressure gas for controlled pressurization but are hindered by the fact that the low viscosity of these gases require that the breakage process be completed in a very short period of time (before the gases can escape) which requires that the initial gas pressures be quite high, on the order of 300 MPa (45,000 psi) or higher. These high pressures result in significant airblast and fly rock which detract from the utility of the process. The propellant gas methods have the advantage over the water/steam pressurization methods in that the gases can expand as they flow into a developing fracture system and thus maintain their ability to adequately pressurize fractures. The propellant gases are comprised primarily of carbon monoxide, however, which requires special ventilation considerations in restricted or underground situations.

The excavation of hard rock for both mining and civil construction and the demolition of concrete structures are often accomplished with conventional explosives. Due to the very high pressures associated with explosive detonation these operations are hazardous, environmentally disruptive, require considerable security, protection of nearby personnel and equipment and must often be applied on an inefficient cyclic basis (as in conventional drill-blast-ventilate-muck operations).

Efforts to develop continuous and more benign excavation/demolition methods has been ongoing due to persistent problems in the industry. The PCF (Penetrating Cone Fracture) method using small propellant charges has proven the most promising to date. However, the PCF method is most limited as it still generates considerable airblast and fly rock, and as the propellant reaction gases may be comprised of over 50 percent carbon monoxide, a poisonous gas. The strength of the PCF method as compared to the other small-charge, electrical discharge and water cannon methods lies in that the propellant gases are able to maintain sufficient pressure for fracturing as the fracture system grows and increases in volume. It is the continuous and maintained pressurization of the developing fractures that enable the PCF method to work efficiently.

The present invention uniquely overcomes the limitations of all the above excavation/demolition methods. The present invention s hows that the proper pressurization of preferred or controlled fractures is the most efficient way to excavate or demolish rock and concrete.

SUMMARY OF THE INVENTION

A preferred excavation/demolition method of the invention has the ability to pressurize a controlled fracture (or system of fractures) in such a manner that pressures to just propagate the fractures (without over pressurizing them) are maintained.

A fluid to achieve such controlled pressurization has a viscosity such that the fracturing process occurs over a longer duration and thus at lower pressures. The fluid is able to store energy that can be used to maintain a desired pressure as the fluid expands into the developing fracture system. The generation, control and application of such a preferred fluid is the subject of the current invention. The current invention or method is based upon using high-pressure foam as the fracturing medium. This method is referred to as Controlled-Foam Injection (CFI) fracturing. The Controlled-Foam Injection method overcomes the limitations of the existing explosive, propellant, water and steam fracture pressurization methods.

In a preferred embodiment, the invention is a continuous excavation/demolition system based upon the controlled fracturing of hard competent rock and concrete through the controlled application of a high-pressure foam-based fluid in pre-drilled holes.

The present invention provides both method and means for maintaining the fracture pressurization needed for efficient fracturing without the adverse aspects of the explosive and propellant based methods.

A preferred fluid may be generated with commercially available pumps and applied to the controlled pressurization of pre-drilled holes by simple and straight forward valving means. A preferred foam, herein considered preferably to be a two-phase mixture of a liquid and a gas, may have a viscosity several orders of magnitude higher than a gas. Foam escapes from a developing fracture system much more slowly than a gas. With a much slower escape of the fracture pressurizing media, the pressures required to initiate, extend and develop the desired fractures is much lower than if a gas is used.

The use of a high viscosity liquid (e.g. water) alone is not sufficient because the relatively incompressible liquid will rapidly lose pressure as the fracture volume increases with fracture growth. A foam in contrast maintains the pressures for efficient fracturing due to the expansion of the gaseous phase of the fluid. Foam has the ability to provide the pressures for efficient controlled fracturing without requiring the excessively high pressures associated with explosives, propellants, water cannons or electrical discharge.

The successful application of a foam based controlled fracturing system of the invention provides the means for generating a foam of certain desirable physical properties; the means to deliver the foam to the bottom of a pre-drilled hole on an as needed basis, in terms of pressure, pressure time behavior and volume; and the means to limit or control the escape of foam around the barrel or other device used to deliver the foam to the hole bottom.

These and further and other objects and features of the invention are apparent in the disclosure, which includes the above and ongoing written specification, with the claims and the drawings.

DETAILED DESCRIPTION OF PREFERRED EMBODIMENTS

Figure 1:
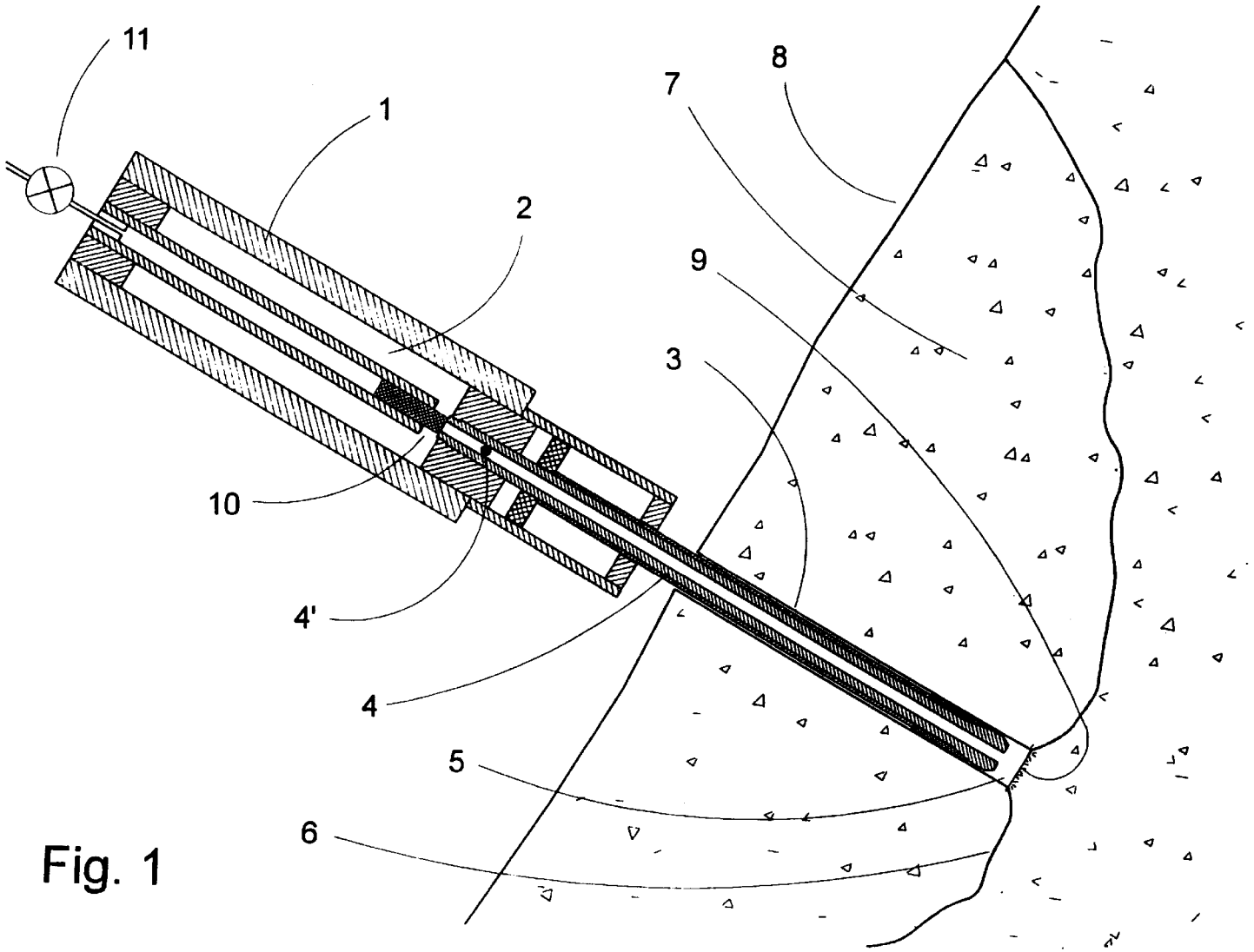
FIG. 1 is a cutaway side view of the present controlled foam injection apparatus for fracturing rock or concrete showing the device placed in a pre-drilled hole.

The Controlled Foam Injection system, as shown in FIG. 1, has a high-pressure reservoir 1 containing a high-pressure foam 2 to be injected into a pre-drilled hole 3 by means of an injection barrel 4, so as to rapidly pressurize the bottom 5 of the hole and thus cause the initiation and propagation of controlled fractures 6, and to remove or excavate a volume 7 of the material.

A pressure transducer 4' monitors the pressure in the barrel and uses the pressure data so obtained for establishing and controlling the pressure in the limited volume reservoir behind the poppet valve. It may also be used for controlling the opening of other valves so as to control the closing of the fast-acting valve.

The drilled hole 3 may be percussively drilled in the surface 8 of a rock or concrete material, so that microfracturing 9 at the hole bottom assists in the initiation of controlled fractures 6. The injection of high-pressure foam 2 is controlled by a reverse acting poppet (RAP) valve 10 the opening of which is controlled by a conventional valve 11 located externally to the device.

Figure 2:
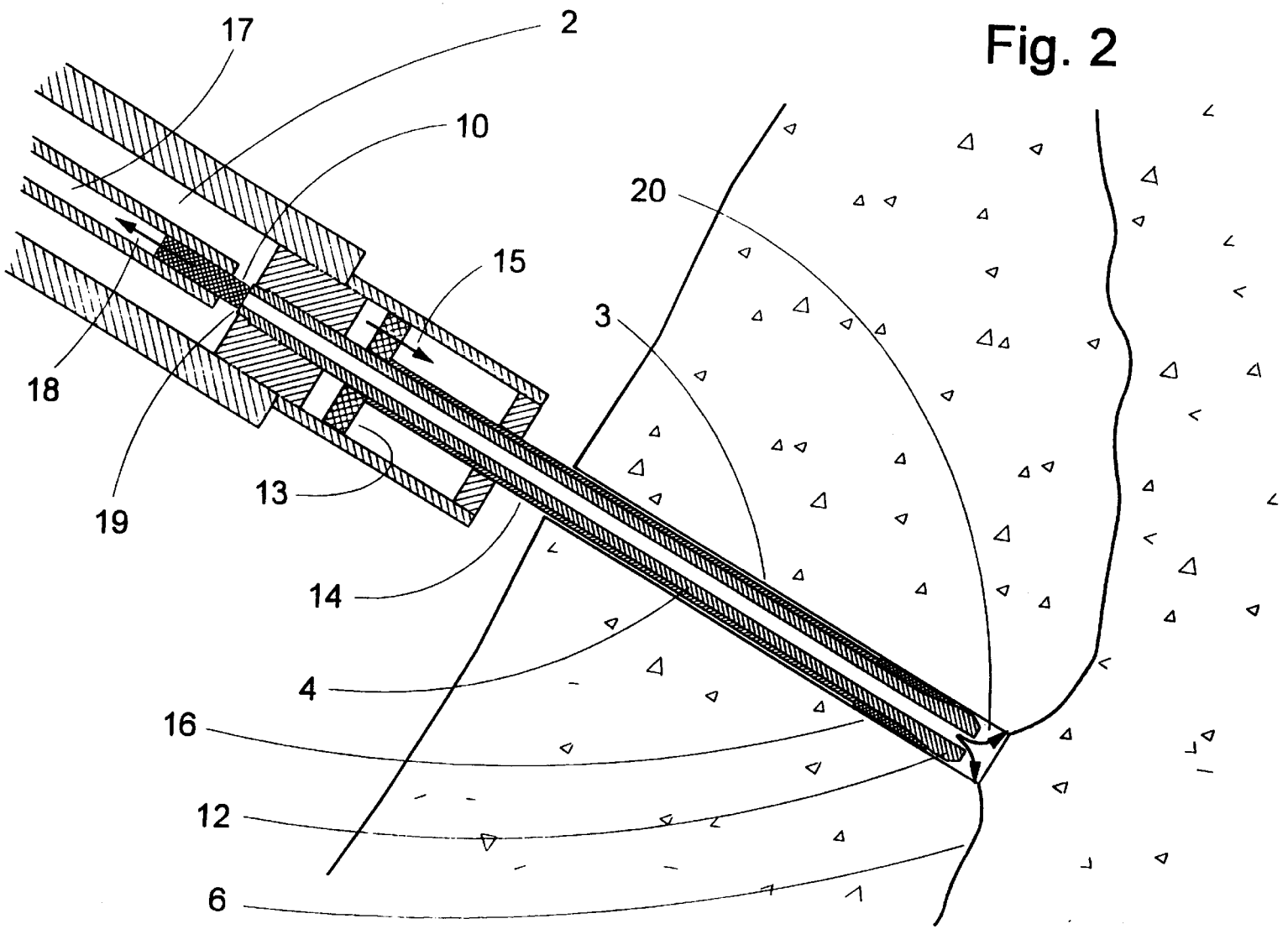
FIG. 2 is a cutaway showing in greater detail the geometry and functioning of the reverse-acting poppet valve and of the annular piston deformation of a ring of deformable material for hole bottom sealing.

Details of the Controlled Foam Injection system as shown in FIG. 2, show an enlarged tip 12 on the end of the injection barrel 4, with a tip diameter only slightly less than the diameter of the hole 3 and show an annular piston 13 acting on a sealing tube 14 located concentrically along a reduced diameter section of the injection barrel. Displacement of the annular piston 13 and the seal tube 14 in the direction indicated by arrow 15 along the injection barrel 4 towards the enlarged tip 12 serves to compress a deformable sealing material 16 such that the sealing material expands radially outwards against the wall of the hole 3 thus effectively sealing the barrel within the hole.

Subsequently, a reverse acting poppet valve 10 is opened by dropping the pressure in a guide tube 17 such that the pressure of the foam in the reservoir rapidly displaces the poppet in the direction indicated by arrow 18 away from its sealing surface 19 and effectively opens the injection barrel for the flow of foam 2 down the barrel and into the hole bottom as indicated by arrows 20 for the controlled fracturing 6 of the material.

Figure 3:
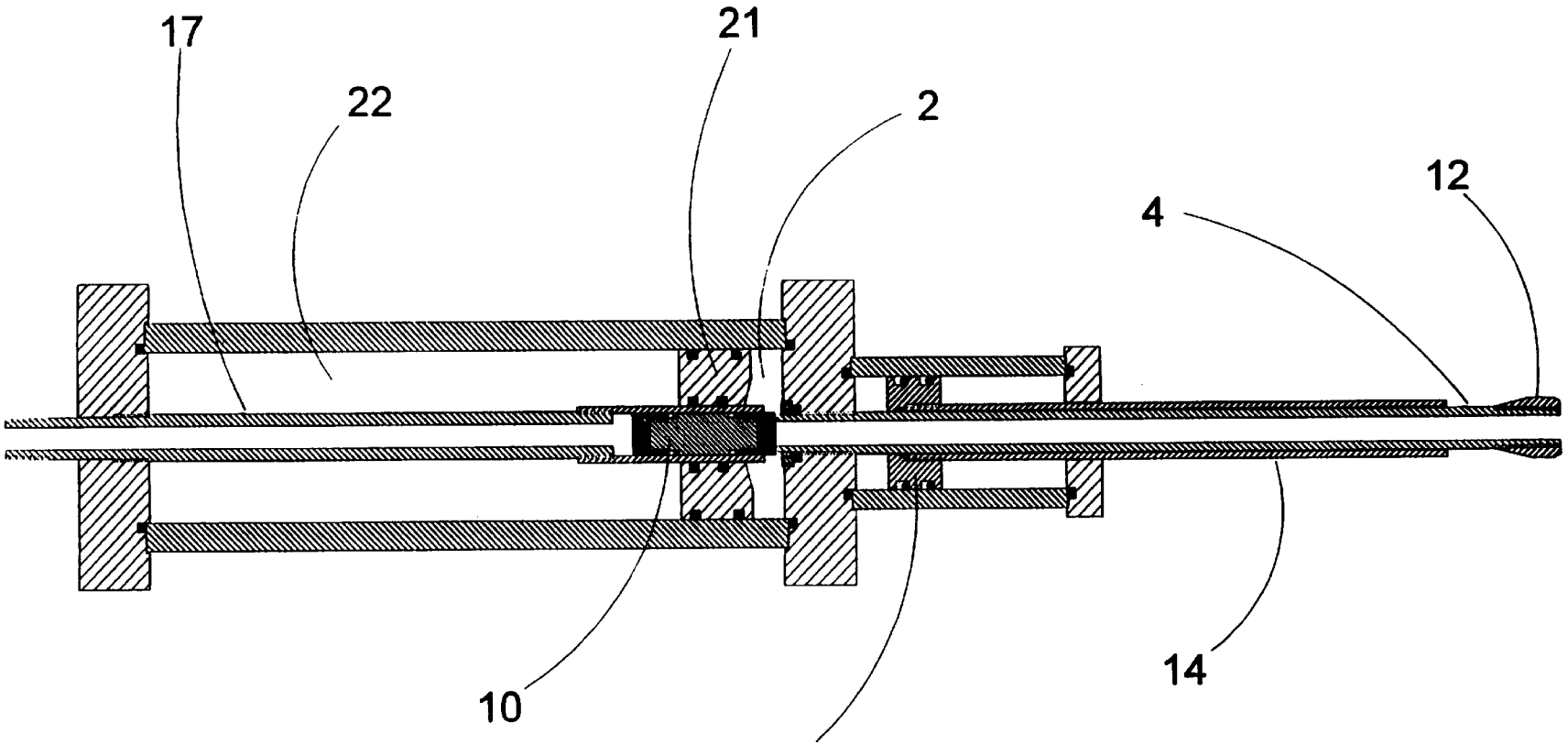
FIG. 3 is a cutaway view showing a free-floating annular piston positioned inside the reservoir so as to limit the amount of foam injected in a breakage cycle while delivering the high pressure needed for optimum breakage and preserving the stored energy in the foam, or gas, behind the piston.

Another preferred embodiment detailed cross section of a Controlled Foam Fracturing device with an internal free floating piston 21 for the control of the quantity of foam to be injected is shown in FIG. 3. The free floating annular piston 21 serves to separate the high-pressure foam to be injected 2 from a compressed fluid 22 which may be foam or a gas and which serves to drive the injected foam 2 into the barrel 4 while maintaining a high foam pressure. Once fracture of the material to be broken is initiated, the pressure of the foam in the barrel 4 drops while the pressure of the foam or gas behind the floating piston 21 is preserved.

FIG. 3 also shows in greater detail design features of the annular piston 13 and sleeve 14 for compressing the material to form the annular hole bottom seal and of the reverse acting poppet 10 of the fast acting valve to discharge foam from the reservoir 2 into the barrel 4.

Figure 4:
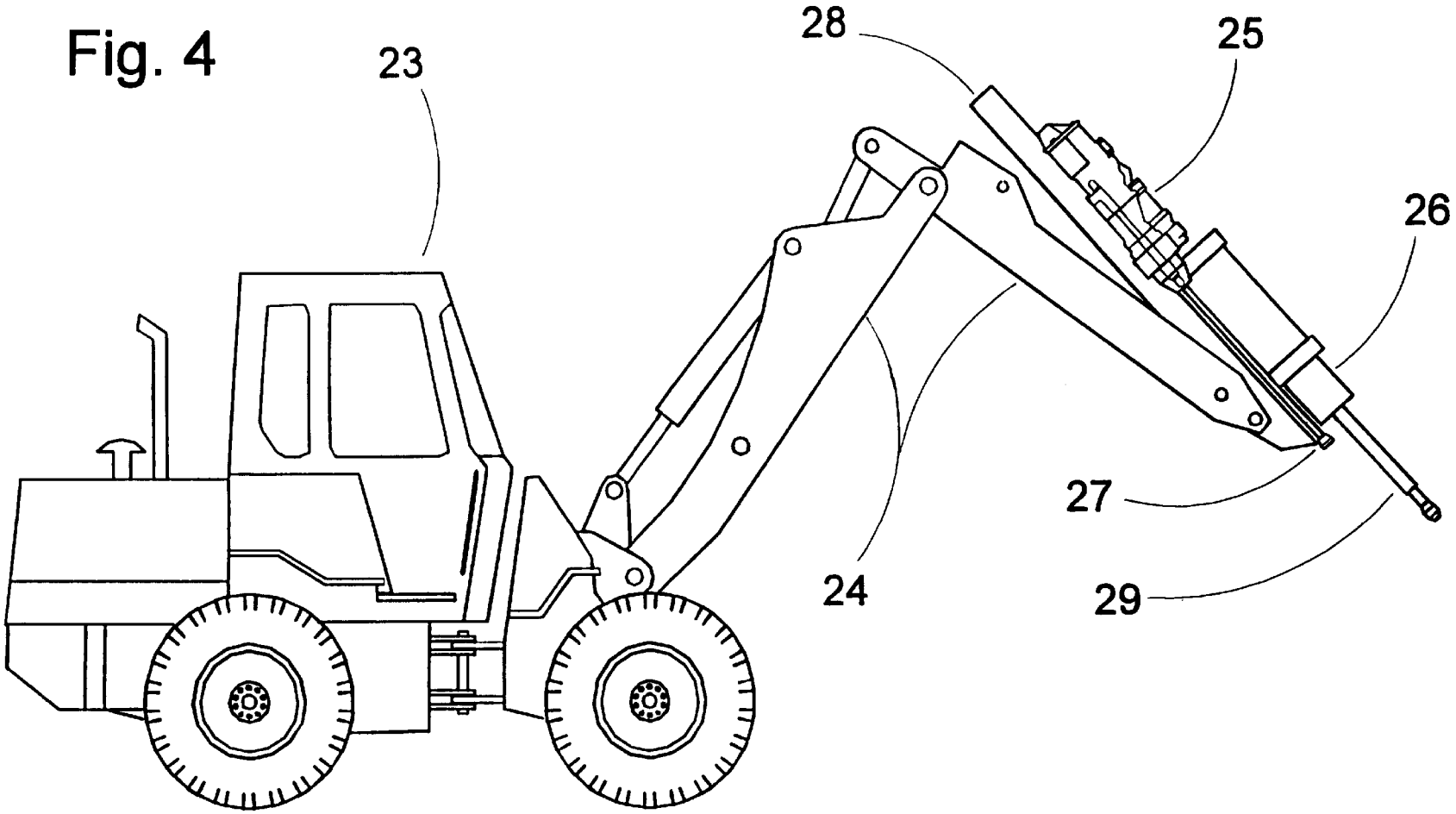
FIG. 4 shows the configuration of controlled foam injection hardware mounted on a typical carrier having an articulated boom with an indexing feed, which includes a means for drilling a hole and then indexing the CFI barrel into the hole.

An integrated and potentially automated machine for applying the Controlled Foam Injection method to the excavation or breakage of rock or concrete is shown in FIG. 4. Either a conventional wheel mounted carrier 23, a tracked carrier, or a specially constructed carrier has at least one articulated boom 24 which carries preferably both a drill 25 and the CFI breakage hardware 26. A percussive drill 25 with drill bit 27 first drills a hole into the material to be broken. An indexing and feed mechanism 28 on the boom 24 is then rotated so as to bring the CFI injection barrel 29 into alignment with the hole and to then insert the barrel into the hole. Upon formation of an annular seal at the bottom of the hole and injection of the high-pressure foam into the hole, a controlled fracture is created serving to fragment, excavate or remove a volume of rock, concrete or other hard material.

The present invention, as illustrated in FIG. 1, addresses all the existing problems in the art and thus provides a method and means for the excavation of rock or the demolition of rock and concrete which is applied on a nearly continuous basis with minimal disruption of the environment and minimal hazard to nearby personnel and equipment.

If the rock or concrete to be fractured is massive, the pressures at the sharp hole bottom corner, as illustrated in FIG. 1, are sufficient to initiate a controlled fracture. Because the CFI method, with hole-bottom sealing, maintains high hole-bottom pressures for long times, the desired fracturing is initiated at much lower pressures than required for PCF or other explosive/propellant based methods where the high-pressure gases rapidly escape. If the rock contains joints or other preexisting fractures, the controlled breakage occurs by the controlled opening and extension of these fractures. In both cases, breakage is achieved by fracturing controlled by the proper pressurization of the very bottom of the drill hole.

Because Controlled Foam Injection (CFI) devices are built to achieve a desired scale of breakage, the CFI method is easily applied to large-scale tunneling or mining operations or to small-scale selective mining, civil construction, boulder breaking or concrete demolition operations.

A foam suitable for fracturing hard competent materials by controlled foam injection may be made from any combination of a liquid and a gas, such as water and air. The surface tension properties of water alone are such that a water/air foam rapidly separates into its separate components. That separation may be slowed or nearly eliminated by using any of numerous commercially available surfactant materials, such as conventional soaps and detergents or preferably specific surfactant compounds, such as lauryl sodium sulfate (sodium dodecyl sulfate).

The stability and viscosity of a foam may be increased by adding a stabilizing additive such as lauryl alcohol (1-dodecanol), a polymer such as polyvinyl alcohol and/or a gel such as guar or hydroxypropyl guar. By varying the ratios of water, surfactant, additives and air, foams over a very broad range of viscosity and stored energy may be made.

Preferably, the foam may be generated externally to the actual controlled fracturing device in a conventional high-pressure reservoir using a variety of mixing and blending means. Alternatively, the foam may be made directly in the storage reservoir of the device by injecting the gas into a previously introduced mixture of water and surfactant through appropriately designed nozzles or orifices.

Only very small quantities of surfactant and additives are required to make foams of suitable viscosity and stability. Preferably, surfactant concentrations of less than one percent (1%) of the aqueous phase are adequate. Increased foam stability and viscosity may be obtained by adding small percentages of a stabilizer (such as lauryl alcohol).

Additions of less than 0.01 percent lauryl alcohol to a foam made with 0.1 percent lauryl sodium sulfate increases foam life by more than a factor of ten. Similarly, concentrations of less than one percent of a polymer (polyvinyl alcohol) or a gel (hydroxypropyl guar) provides adequate foam stability and viscosity for most breakage applications.

In breaking a highly fractured material, it may be desirable to increase foam stability and viscosity by increasing the concentrations of the various additives to over one percent of the aqueous phase. Preferably, the best foam properties, in terms of stability and viscosity, may be obtained by using small percentages of three or four additives rather than a large concentration of any one.

The high pressure gas used to generate the required foams may be obtained with conventional and commercially available compressors and gas intensifiers. Compressors deliver air at pressures up to 3 Mpa (4,350 psi) and gas intensifiers increase this pressure up to 10 MPa (14,500 psi). If nitrogen rather than air were to be used, the nitrogen could be obtained from commercially available pressurized cylinders or from a conventional nitrogen vaporization plant using liquid nitrogen as the source.

Once the device reservoir is charged with the desired foam at the desired pressure, the foam is released into the predrilled hole by means of a rapid acting reverse firing poppet valve. A reverse acting poppet (RAP) valve, as illustrated in FIG. 2, is preferred for controlling high-pressure foam injection because the valve has only one moving part (the poppet), and opens very rapidly when the pressure is dropped in the control tube behind the poppet.

As soon as the poppet moves, the reservoir foam pressure acts on the full sealing face of the poppet causing it to rapidly retract or open. In addition, the RAP valve may be designed to close rapidly once the pressure of the foam being injected drops below a given pressure, as occurs when the rock or concrete material fractures.

By maintaining a lower residual pressure in the poppet guide tube, the poppet recloses once the delivery pressure (driving foam injection and fracturing) drops below the residual pressure. The rapid opening is important so that the bottom of the pre-drilled hole may be brought to a high enough pressure rapidly enough to induce the desired combination of hole-bottom fracturing and radial fracturing for achieving a desired fragment size. The rapid closing with pressure drop is desirable to avoid injecting more foam than is need to achieve the desired fracturing. Excess foam injection represents a waste of energy and results in some increase in the albeit low airblast and flyrock associated with CFI fracturing.

The delivery of a determined quantity of foam to the bottom of the hole may also be controlled by a pressure sensor and accompanying electronic valve control system. A conventional high-pressure sensor monitors the pressure in the injection barrel and may be programmed to sense the pressure drop associated with the onset of fracturing. At a predetermined pressure drop a valve system closes the poppet valve control tube and recharges that tube with the pressure needed to rapidly re-close the poppet valve, thus preserving high-pressure foam still in the reservoir.

Delivery of a controlled quantity of foam may also be realized by purely mechanical means. A free-floating annular piston may be provided between the guide tube for the fast-acting, poppet-piston valve and an inside diameter of the reservoir as shown in FIG. 3. The annular piston may be positioned such that the volume of high-pressure foam ahead of the piston, and thus near the opening of the fast-acting valve, is controlled as an ideal volume for effectively fracturing and removing the material to be broken.

The volume of foam ahead of the piston may be tailored to meet specific breakage requirements and thus reduce the injection of foam beyond that required for efficient breakage. In addition, the composition of the foam to be injected (ahead of the annular piston) may be different from the foam behind the piston, with the foam to be injected having a gas concentration tailored to the desired breakage and with the fluid behind the piston being a foam or a gas.

The delivery of a controlled quantity of foam may also be realized with a mechanical or electronic valve control timing system such that the poppet valve control tube is de-pressurized, for poppet valve opening, and then rapidly re-pressurized for poppet valve closing. This timing system may be adjusted continuously during breakage or excavation operations to always provide for the injection of the quantity of foam needed for efficient breakage without the injection and waste of foam beyond that needed.

Another preferred feature of the present invention relates to the sealing of the foam injecting barrel into the pre-drilled hole. Although the high viscosity of foam as compared to a gas or even water reduces the need for near perfect sealing, the quality of a seal serves two purposes. The tighter the seal in terms of foam leakage the less foam is lost between the barrel and the hole. If the seal also acts to lock and hold the barrel in the hole the high pressures of foam injection fracturing are not able to accelerate the device out of the hole.

One of the problems with the PCF method is the lack of a locking seal and the very large recoil forces that are imparted to the PCF device. Contrastingly, the preferred sealing means for CFI fracture utilizes a barrel with a bulb enlargement at its tip and an annular hydraulic piston acting around the smaller diameter section of the barrel, as illustrated in FIG. 2.

Sealing is effected by crushing an annulus of deformable material between the bulb tip and the annular piston. The crushing of material along the axis of the hole causes it to expand radially and seal against the hole wall near the bottom of the hole. Application of high-pressure foam causes the barrel to retract or recoil and further jam the material against the hole wall. With the appropriate selection of bulb tip angle and deformable material, the recoil further jams the material against the hole wall and maintains a very effective seal.

Any deformable material may be used to make the annular seal. Preferably, a rubber or elastomer seal may be used in breaking softer and more homogenous materials with the sealing material being reusable for several breaking cycles. It may be desirable in some cases to have a hard granular abrasive material incorporated into the rubber or elastomer to increase the frictional locking of the seal in the hole.

For breaking harder and more heterogeneous materials (such as jointed or fractured rock) an expendable seal may be made from a granular material such as sand, fine gravel or a cementitious mix. A sand or gravel seal may be injected into the space between the bulb tip and the annular piston with compressed air once the barrel was properly positioned in the hole.

By using a cementitious material similar to conventional mortar mix or by mixing sand or gravel with a bonding material such as epoxy resin, latex or other glue, solid replaceable seals may be made at very low cost. Such solid seals are positioned on the barrel, between the bulb tip and the annular piston, prior to each breakage cycle. The seals may be made of two or more segments held on the barrel by encircling bands of rubber, metal or other material. Tests made to date with a variety of cementitious materials have given excellent sealing, with almost no gas/foam leakage around the barrel when breaking a hard granite at pressures up to 80 MPa (11,600 psi).

Tests conducted with small-scale prototype CFI equipment have shown a consistent ability to fracture or excavate a hard competent granite. Besides being able to break rock these tests demonstrated that the CFI method generates minimal fly rock and air blast, both of which were significant for the PCF method and other small-charge approaches.

Tests conducted to date have shown that a hard competent granite may be fractured, without the benefit of edge effects, at foam pressures in the range of 50 Mpa (7,250 psi) to 80 Mpa (11,600 psi). These pressures are one fifth to one third those required for fracturing with propellant gases, as used in the PCF method. The lower pressure required is a result of the lower rate of the process which is possible because of the viscosity of the foam and the improved hole bottom sealing as described above.

Softer rocks, fractured and jointed rocks and concrete are all be broken at lower pressures, in some cases, at pressures less than 10 Mpa (1,450 psi). In breaking softer and jointed or fractured materials, the viscosity of the foam is a critical parameter. The fracturing fluid viscosity control offered by the CFI method prevents the premature loss of fluid pressures thus enhancing completion of the controlled fracture system leading to the desired breakage.

Others significant benefits derive from the unique viscous properties of foams. The viscosity of a foam depends strongly upon foam quality, defined as the volume fraction of gas. Foams of quality below 50% (gas volume less than 50%) typically have viscosities only slightly higher than that of the liquid phase. As foam quality increases above 50% and up to about 90%, foam viscosity increases markedly and can be much more than an order of magnitude higher than that of the liquid phase. As foam quality increases above 95%, the foam breaks down into a mist and the viscosity drops rapidly to approach that of the gas phase.

In a preferred CFI fracturing operation the foam is generated initially with a quality below 50%, albeit at very high pressure. As the foam expands into the developing fracture system, foam quality increases with a concordant increase in viscosity until the foam has expanded to 95% or more quality. That variation of effective viscosity with expansion actually serves to improve the efficiency of the CFI process. While the highest pressure foam is being generated, delivered to the injection device and injected via the barrel into the hole, viscosity is low, as desired.

Once the rock or concrete begins to fracture, the foam expands and viscosity increases preventing the premature escape of the pressurizing medium before breakage is complete. Once breakage is complete the foam expands further, and as a foam quality over 95% is realized, the viscosity drops allowing the foam (now a gas mist) to escape more rapidly thus reducing the time that high pressure foam accelerates fragments of the broken material. By appropriately designing the foam, a sequence of viscous behaviors optimally tailored to the foam-injection material-breakage process is achieved.

Once the material is broken, the residual foam rapidly expands. As noted above, once foam quality (percent gas) rises above 95 percent with expansion the foam becomes a mist. Thus the only byproduct of the CFI process is an aqueous mist with the amount of liquid (water) mixed in the air being 1 to 2 liters per cubic meter of material broken. As none of the surfactants or other foam stabilizing additives envisioned for use are toxic, that mist poses little problem.

In an underground mining or tunneling operation the mist is swept rapidly away from the working area by the forced air ventilation systems already required for such operations. In a surface rock breaking or concrete demolition operation the volume of the expanded mist may be less than one cubic meter and be quickly dissipated in the ambient air.

The CFI method may be complemented with an explosive, propellant, or electrical discharge means to provide a very short duration pressure pulse at the hole bottom just after foam injection so as to assist in the initiation of controlled fractures.

A very small charge explosive and/or propellant device may be placed on or near the end of the injection barrel and initiated by a pressure sensitive primer designed to initiate when the hole bottom pressure due to foam injection reached a predetermined and desired level. The very short duration pressure pulse provided by such a charge may be significantly higher that the foam pressure and thus enhance to initiation of desired controlled fractures at or near the hole bottom.

An electrical discharge system involves the placement of an exploding bridge wire at or near the end of the injection barrel with the discharge of an electrical capacitor through the bridge wire serving to heat the bridge wire so rapidly that the wire explodes and provides the desired short duration pressure pulse.

An electrical discharge pressure pulse may also be generated by discharging a capacitor through a foam of appropriate electrical conductivity by means of electrodes situated at the end of the injection barrel. Discharge of the capacitor for either a bridge wire or conducting foam system is controlled by timing and/or foam pressure sensing circuits.

The benign nature of rock and concrete breakage characteristic of the CFI method provides a method and means for the excavation of rock or the demolition of concrete which is applicable on a nearly continuous basis with minimal disruption of the environment and minimal hazard to nearby personnel and equipment. Because the controlled foam injection (CFI) device is built to achieve a desired scale of breakage, the CFI method applies equally well to large-scale tunneling or mining operations, to small-scale selective mining, civil construction and boulder breaking, or to concrete demolition operations.

The hardware for the CFI fracture of rock or concrete may be easily mounted on an articulated boom for the automated application to excavation or demolition. Most of the equipment for developing a CFI breakage system is conventional mechanical and hydraulic hardware already available in the mining and construction industries. Minimal development needs to be given to new or complicated hardware components. For example, CFI equipment may be mounted on a conventional carrier, loader or excavator as depicted in FIG. 4.

The machine depicted in FIG. 4 incorporates a percussive drill on the same boom carrying the CFI hardware so that hole drilling, indexing for CFI barrel placement and breakage is carried out in a systematic and automatic manner. It is important to note that the environment of CFI breakage is so benign in terms of air blast and flyrock that very little consideration need be given to protecting equipment or personnel. Data obtained to date indicate that airblast and flyrock are much less than with any of the previously developed water canon, small charge explosive, propellant, and electrical discharge techniques.

Automation and Commercial Application

The small incremental material removed, combined with the nearly continuous operation of a relatively small-scale breakage system, make CFI breakage ideally suited to automation. The process is flexible enough (in terms of hole depth and foam pressure, quality and viscosity) that it is tailored rapidly to changing ground conditions.

The benign nature of the airblast and flyrock of the CFI fracturing method allows drilling, CFI breakage, mucking, ground support and haulage equipment to remain at the working face during rock excavation operations. The incremental application of the process and many measurable aspects of the process (e.g. drilling rate, foam pressure drop, et cetera) allow for data on rock (or concrete) properties relevant to breakage to be obtained on a continuous basis. With the appropriate sensors, algorithms, control programs, and actuators the application of CFI breakage becomes highly automated and efficient.

Preferably, a highly automated CFI breakage system includes most or all of the following basic components:

- a carrier.
- one or more booms to carry drilling and CFI hardware.
- a drill mounted on each boom assembly, with provisions for indexing with
- the CFI injection hardware, with provisions for hole sealing.
- foam generating and flow control hardware.
- mucking and haulage systems.
- ground support installation systems, such as shotcrete or rock bolts.

The basic components of a representative CFI system are shown schematically in FIG. 4. The principal characteristics of these various components have been described earlier.

The Carrier

The carrier may be any standard mining or construction carrier or any specially designed carrier for mounting the boom, or booms, and may include equipment for mucking and ground support. Special carriers for raise boring, shaft sinking, stoping, narrow-vein mining and for military operations, such as trenching, fighting position construction et cetera, may be built.

Boom Assemblies

The boom, or booms, may be any standard articulated boom, such as used on mining and construction equipment or any modified or customized boom. The boom(s) serves to carry both the drilling and CFI breakage equipment, to orient and position each for proper functioning and to provide for indexing between the two as desired.

Drills

The drill, or drills, consists of a drill motor, drill steel and drill bit. The drill motor may be rotary or percussive with the latter being either pneumatically or hydraulically powered. The preferred drill type is a percussive drill because percussive drilling generates micro-fractures in the rock, or concrete, at the bottom of the drill hole. Much micro-fractures acts as initiation points for CFI fracturing, with lower foam pressures being required and a more controlled fracture system being developed.

Standard drill steels or specially shortened drill steels may be used. The latter is tailored to the short hole requirements of the CFI method. Standard rock drilling bits are used to drill the holes. Special percussive drill bits designed to enhance micro-fracturing may be developed. Drill hole sizes may range from less than one inch to several inches in diameter. Hole depths may range from 4 to more than 10 hole diameters, with the depth depending upon, and being tailored to, the breakage characteristics of the material.

CFI Injection Hardware

The hardware for controlled foam injection comprises a reservoir to contain a high-pressure foam, a barrel to be inserted into a pre-drilled hole, a rapidly acting valve to deliver the foam from the reservoir down the barrel to the bottom of the hole and a sealing mechanism to seal and hold the barrel in the hole. Due to the moderate pressure requirements, the barrel and the reservoir may be of conventional design and made of conventional high-strength steels.

The fast-acting valve may be a conventional ball type valve, but a reverse acting poppet valve as described above provides for faster valve opening times and a more efficient delivery of foam to the hole. The sealing of the barrel into the hole is the most critical and important feature of the injection hardware. The compressing of a crushable or deformable material between an annular piston and a bulb tip on the barrel provides a seal which both locks the barrel into the hole and which improves in seal quality as pressure is applied to the bottom of the hole.

Foam Generating and Flow Control Hardware

Foam for the CFI process may be generated within the reservoir attached to the barrel or may be generated externally to the reservoir and delivered to the reservoir as needed with appropriate tubing and valving. Foam may be generated within the reservoir by first injecting the required amount of liquid (water) and additives into the reservoir and then injecting a high-pressure gas into the reservoir through nozzles or orifice plates designed to enhance mixing of the two phases.

Foam of more consistent and higher quality may be generated in an external reservoir. An external reservoir need not have the geometric constraints of the primary reservoir and may incorporate additional baffles, orifice plates, sand packs and other devices to enhance the mixing of the two phases. An external reservoir may also allow for some recycling of the foam through the baffles, orifice plates, et cetera so as to improve mixing and foam quality. Foam generated in an external reservoir then may be delivered to the primary reservoir by conventional high-pressure tubing and valves on an as needed basis.

Mucking and Haulage Systems

A fully integrated and automated CFI excavation or breakage system incorporates hardware to remove (muck)

the material as it is broken. A mucking system includes both a gathering means, such as hydraulic arms (much like a backhoe) or rotating disks with gathering fingers or ribs, and a conveyor means to move the gathered material past the machine. A chain conveyor operating through the middle of the carrier is commonly used.

Broken material gathered by the arms or disks is passed through the carrier and delivered onto trucks, rail cars or a belt conveyor system for further removal. Many such mucking systems are in existence for mining and tunneling operations and be readily adapted or modified for a CFI system.

Ground Support Installation Systems

A fully intergrated and automated CGI excavation system also includes hardware for proving ground support in a tunneling or mining operation. Conventional ground support means, such as shotcrete or rock bolts, may be installed by hardware mounted on the CFI carrier. With a means for installing ground support incorporated into the CFI system, mining or tunneling operations progress continuously without needing to stop and remove the CFI carrier to bring in a ground support installation system.

Applications of the CFI Method

The CFI method may be used to break soft, medium and hard rock as well as concrete. The method has many applications in the mining and construction industries and for military operations. These applications include, but are not limited to:

tunneling, cavern excavation, shaft-sinking, rock cuts, rock trenching, precision blasting, reduction of oversize boulders, adit and drift development for mines, longwall mining, room and pillar mining, stoping (such as cut & fill, shrinkage and narrow-vein), selective mining, secondary breakage, raise-boring, demolition, construction of fighting positions and personnel/equipment shelters in rock, and reduction of natural and man-made obstacles to military movement.

While the invention has been described with reference to specific embodiments, modifications and variations of the invention may be constructed without departing from the scope of the invention, which is defined in the following claims.

I claim:

1. An apparatus for breaking rock, concrete and other hard materials with a controlled fracturing technique, comprising:

a high-pressure foam injection barrel having an entry end and a distal end for inserting into a pre-drilled hole in a material to be broken;

a high-pressure reservoir containing a high-pressure foam, a high-pressure seal mounted proximal the distal end of the barrel for sealing between the barrel and a wall of the hole;

a fast-acting, high-flow valve connected to the reservoir and to the entry end of the barrel for releasing the high-pressure foam down the barrel and rapidly pressurizing a bottom of the hole and for fracturing the material through the initiation and propagation of controlled fractures from the bottom of the hole and thus effectively breaking and removing a volume of the material.

2. The apparatus of claim 1, wherein the fast-acting, high flow valve comprises a poppet piston positioned in a guide tube aligned with the entry end of the injection barrel for forming with the piston a seal between the entry end of the barrel and the reservoir when a rear end of the piston is pressurized to the same pressure as the reservoir and for rapidly accelerating the piston rearwards when pressure on the rear end of said piston is sufficiently reduced, thus opening the valve between the barrel and the reservoir and rapidly pressurizing the barrel and the bottom of the pre-drilled hole with high-pressure foam.

3. The apparatus of claim 2, further comprising a free-floating annular piston located between the guide tube for the fast-acting, poppet-piston and the reservoir and wherein said annular piston is positioned for controlling a volume of high-pressure foam ahead of the annular piston and near the opening of the fast-acting valve as an ideal volume for effectively fracturing and removing the volume of material to be broken and for reducing injection of foam beyond that required for efficient breakage.

4. The apparatus of claim 1, wherein the fast-acting valve closes once the pressure acting down the barrel drops below a certain level resulting from the successful fracturing of the material, for stopping flow of high-pressure foam down the barrel and preserving any foam remaining within the reservoir.

5. The apparatus of claim 4, further comprising a limited volume reservoir behind a poppet piston of the fast-acting valve for maintaining a pressure for causing the poppet piston to close once pressures in the barrel drop below a predetermined amount due to the successful fracturing of the material.

6. The apparatus of claim 5, further comprising a pressure transducer for monitoring the pressure in the barrel and for using the pressure data so obtained for establishing and controlling the pressure in the limited volume reservoir behind the poppet valve or for controlling the opening of other valves so as to control the closing of the fast-acting valve.

7. The apparatus of claim 1, wherein the high-pressure seal for sealing between the barrel and the hole wall comprises an enlarged tip at the distal end of the barrel having an outer diameter only slightly less than a diameter of the hole, a deformable sealing material for compressing against the enlarged tip and an annular piston around and concentric with the barrel for compressing the deformable material against the enlarged tip.

8. The apparatus of claim 7, wherein the deformable sealing material is selected from a group consisting of a granular material, sand or gravel; a cementitious material, mortar or concrete; a plastic based material; a rubber based material; a soft metal, lead or copper; or any combinations thereof.

9. The apparatus of claim 1, wherein a liquid phase of the foam comprises an aqueous solution containing a surfactant, sodium dodecyl sulfate; a stabilizer, lauryl alcohol (1-dodecanol); a polymer, polyvinyl alcohol; a gel, guar or hydroxypropyl guar or any combination of these.

10. The apparatus of claim 1, wherein the gaseous phase of the foam comprises air, nitrogen and other gases in any mixture.

11. The apparatus of claim 1, wherein the foam is made such that foam quality defined as percent gaseous phase will change during foam expansion resulting from injection and fracturing so as to result in variations in foam viscosity which are tailored to certain aspects of the technique.

12. The apparatus of claim 1, wherein the foam is made of or contains cementitious materials such that any foam injected into fractures not leading to removal or excavation of the material will eventually harden into a solid serving to improve the mechanical and/or hydrological properties of the non-excavated material.

13. The apparatus of claim 1, wherein the foam properties are tailored, in terms of viscosity and foam quality to provide the optimum amount of energy to just break the material, without providing excessive energy which would be less efficient and would result in increased noise and thrown material.

14. A method for breaking rock, concrete and other hard materials with a controlled fracturing technique, comprising:

inserting a high-pressure foam injection barrel into a pre-drilled hole in material to be broken;

establishing a high-pressure seal between the barrel and a wall of the hole;

providing a high-pressure foam within a high-pressure reservoir connected to the barrel;

opening a fast-acting, high-flow valve connecting the reservoir to the barrel, releasing the high-pressure foam down the barrel, rapidly pressurizing a bottom of the hole and fracturing the material by initiating and propagating controlled fractures from a bottom of the hole and effectively breaking and removing a volume of the material.

15. The method of claim 14, wherein the establishing the high-pressure seal between the barrel and the hole wall comprises:

providing an enlarged tip at a distal end of the barrel, with a diameter only slightly less that the diameter of the hole;

driving along the barrel an annular piston around and concentric with the barrel;

compressing a deformable material against the enlarged tip and crushing the deformable material radially outward for forming the seal.

16. The method of claim 15, further comprising selecting the deformable material from a group of deformable sealing materials consisting of a granular material, sand or gravel; a cementitious material, mortar or concrete; a plastic based material; a rubber based material; a soft metal, lead or copper; or any combinations thereof.

17. The method of claim 14, further compromising closing the fast-acting valve once pressure acting down the barrel drops below a certain level resulting from successful fracturing of the material, stopping flow of high-pressure foam down the barrel and conserving any foam remaining within the reservoir.

18. The apparatus of claim 17, wherein the closing of the fast-acting valve further comprises closing a reverse-acting poppet valve once pressures in the barrel drop below a predetermined amount by a residual pressure in a limited volume reservoir behind the reverse-acting poppet valve.

19. The method of claim 17, further comprising monitoring pressure in the barrel by a pressure transducer and using pressure data so obtained for establishing and/or controlling pressure in the reservoir behind the poppet valve and controlling closing of the fast-acting valve.

20. The method of claim 14, wherein the providing foam comprises providing a liquid phase of the foam made of an aqueous solution containing substances selected from a group consisting of a surfactant, sodium dodecyl sulfate; a foam stabilizer, lauryl alcohol (1-dodecanol); a polymer, polyvinyl alcohol and/or a gel, guar or hydroxypropyl guar.

21. The method of claim 14, wherein the providing foam comprises providing a gaseous phase of the foam comprising normal air, nitrogen and other gases.

22. The method of claim 14, wherein the providing foam comprises providing foam having a quality defined as percent gaseous phase change during foam expansion resulting from injection and fracturing resulting in variations in foam viscosity tailored to an application process.

23. The method of claim 14, wherein the providing foam comprises providing foam containing cementitious materials whereby the foam injected into fractures not leading to excavation of material hardens into a solid for improving mechanical and/or hydrological properties of non-excavated material.

24. The method of claim 14, further comprising pre-drilling the hole by percussive means for increasing a number and a size of microfractures at a hole bottom and thereby improving initiation of fractures at the hole bottom.

25. An apparatus for breaking rock, concrete and other hard materials with a controlled fracturing technique, comprising:

a carrier;

at least one articulated boom mounted on the carrier;

a drill mounted on at least one boom for drilling a hole in material to be broken;

a high-pressure foam injection barrel provided on at least one boom;

a high-pressure reservoir containing a high-pressure foam;

a high-pressure seal between the barrel and a wall of the hole;

a fast-acting, high-flow valve connecting the reservoir to the barrel for releasing the high-pressure foam down the barrel and for rapidly pressurizing a bottom of the hole and fracturing material through initiation and propagation of controlled fractures from a bottom of the hole thereby effectively breaking and removing a volume of material.

26. The apparatus of claim 25, wherein the high-pressure seal between the barrel and the hole wall comprises an enlarged tip at an end of the barrel having a diameter only slightly less than a diameter of the hole and a deformable material for compressing against the enlarged tip with an annular piston acting around and concentric with the barrel.

27. The apparatus of claim 26, wherein the deformable sealing material is selected from a group consisting of a granular material, sand or gravel; a cementitious material, mortar or concrete; a plastic based material; a rubber based material; a soft metal, lead or copper; or any combinations thereof.

28. The apparatus of claim 25, wherein the fast-acting valve closes once the pressure acting down the barrel drops below a certain level resulting from the successful fracturing of the material, thereby stopping flow of high-pressure foam down the barrel and preserving foam remaining within the reservoir.

29. The apparatus of claim 28, further comprising a limited volume reservoir connected to a reverse-acting poppet for maintaining a pressure for causing the poppet to close when pressures in the barrel drop below a predetermined amount after successful fracturing of material.

30. The apparatus of claim 29, further comprising a pressure transducer for monitoring a pressure in the barrel and obtaining pressure data for establishing and controlling the pressure in the reservoir behind the poppet valve or controlling an opening of other valves for closing the fast-acting valve.

31. The apparatus of claim 25, wherein the liquid phase of the foam is an aqueous solution containing a surfactant, sodium dodecyl sulfate; a stabilizer lauryl alcohol (1-dodecanol); a polymer, polyvinyl alcohol; a gel, hydroxypropyl guar or any combination of these.

32. The apparatus of claim 25, wherein the gaseous phase of the foam comprises normal air, nitrogen and other gases in any mixture.

33. The apparatus of claim 25, wherein the foam has a quality defined as percent gaseous phase change during foam expansion resulting from injection and fracturing resulting in variations in foam viscosity tailored to an application process.

34. The apparatus of claim 25, wherein the foam comprises cementitious materials such that any foam injected into fractures not leading to removal or excavation of material hardens into a solid serving to improve mechanical and/or hydrological properties of non-excavated material.

35. An apparatus for sealing a high-pressure injection tube or barrel into a cylindrical hole, comprising:

the injection tube or barrel delivering a high-pressure compressible fluid, whether a liquid, a gas or a foam, into a hole in a material for injecting said liquid into said material, whether for the purpose of fracturing said material or for impregnating any pore space in said material with said liquid;

an enlarged tip on an in-hole end of said tube or barrel, such that the enlarged tip has a diameter only slightly less than a diameter of the hole;

a reduced diameter cylindrical section on said tube or barrel located behind the enlarged tip and of a diameter such that a ring of sealing material is placed around the reduced section and behind the enlarged tip;

an annular piston with an internal diameter designed to slide along and concentric with the reduced section of said tube or barrel and an external diameter slightly less than the diameter of the hole, with the ring of deformable material located between said annular piston and the enlarged tip;

means for displacing said annular piston in a direction towards the enlarged tip such that the ring of deformable material is compressed whereby the material expands radially and compresses against a wall of the hole thereby forming a seal against any high pressure fluid injected into the hole by the tube or barrel.

36. The apparatus of claim 35, wherein the enlarged tip has a gradual change in diameter giving a tapered or conical transition from the maximum diameter of the tip to the diameter of the reduced-diameter, cylindrical portion of the tube or barrel, with said taper serving to increase the compression and radial deformation of the sealing material as the high-pressure fluid in the hole attempts to displace the tube or barrel out of the hole and to thus increase the effectiveness of the seal.

37. The apparatus of claim 35, wherein the deformable sealing material is selected from a group consisting of a granular material, sand or gravel; a cementitious material, mortar or concrete; a plastic based material; a rubber based material; a soft metal, lead or copper; or any combinations thereof.

38. The apparatus of claim 35, wherein the means for displacing is selected from a group consisting of mechanical, hydraulic or pneumatic means.

* * * * *